US011661807B1

(12) United States Patent
Soh et al.

(10) Patent No.: US 11,661,807 B1
(45) Date of Patent: May 30, 2023

(54) ROTATING HANGER ASSEMBLIES AND METHODS

(71) Applicant: Cameron International Corporation, Houston, TX (US)

(72) Inventors: Pheng Aun Soh, Singapore (SG); Juan Carlos Gonzalez, Houston, TX (US); Timothy Phythian, Spring, TX (US); Craig Cotton, Cypress, TX (US)

( * ) Notice: Subject to any disclaimer, the term of this patent is extended or adjusted under 35 U.S.C. 154(b) by 121 days.

(21) Appl. No.: 17/128,402

(22) Filed: Dec. 21, 2020

Related U.S. Application Data

(60) Provisional application No. 62/951,184, filed on Dec. 20, 2019.

(51) Int. Cl.
*E21B 23/01* (2006.01)
*E21B 33/04* (2006.01)

(52) U.S. Cl.
CPC ..... *E21B 23/01* (2013.01); *E21B 33/04* (2013.01); *E21B 33/0415* (2013.01)

(58) Field of Classification Search
CPC ..... E21B 23/01; E21B 33/04; E21B 33/0415
See application file for complete search history.

(56) References Cited

U.S. PATENT DOCUMENTS

| | | | | |
|---|---|---|---|---|
| 8,528,650 | B1 | 9/2013 | Smith et al. | |
| 9,027,658 | B2 | 5/2015 | Bories et al. | |
| 9,506,329 | B2 | 11/2016 | Massey et al. | |
| 9,598,924 | B2 | 3/2017 | Nguyen et al. | |
| 9,689,229 | B2 | 6/2017 | Hanson et al. | |
| 9,863,205 | B2 | 1/2018 | Levert et al. | |
| 9,909,385 | B2 | 3/2018 | Cocker et al. | |
| 10,094,188 | B1 | 10/2018 | Smith | |
| 10,233,714 | B2 | 3/2019 | Cheah et al. | |
| 10,323,480 | B2 | 6/2019 | Cocker et al. | |
| 10,648,243 | B1 | 5/2020 | Burrows | |
| 10,794,140 | B2 | 10/2020 | Nguyen | |
| 10,851,607 | B1 | 12/2020 | Cavanagh | |
| 2015/0041151 | A1* | 2/2015 | Cocker, III | E21B 33/0415 166/380 |
| 2015/0152701 | A1* | 6/2015 | Levert, Jr. | E21B 33/04 166/85.1 |
| 2017/0167218 | A1* | 6/2017 | Cheah | E21B 23/02 |

* cited by examiner

*Primary Examiner* — Yong-Suk (Philip) Ro
(74) *Attorney, Agent, or Firm* — Eubanks PLLC

(57) ABSTRACT

A wellhead hanger assembly is provided. In one embodiment, a system includes a wellhead hanger, an inner sleeve coupled to the wellhead hanger, a running tool coupled to the inner sleeve, and an outer sleeve coupled to the running tool. The outer sleeve may be positioned to transmit torque from the running tool to the wellhead hanger, and the wellhead hanger may be in castellated engagement with the outer sleeve via a set of castellations and mating slots. Additional systems, devices, and methods are also disclosed.

20 Claims, 12 Drawing Sheets

ROTATING HANGER ASSEMBLIES AND METHODS

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently cemented into place within the well. During a cement job, cement can be pumped down a casing string in a well, out the bottom of the casing string, and then up the annular space surrounding the casing string. The cement is then allowed to set in the annular space. Wells can also include tubing strings that facilitate flow of fluids through the wells. Hangers can be attached to the casing and tubing strings and received within wellheads to enable these tubular strings to be suspended in the wells from the hangers.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to wellhead hangers for suspending tubular strings in wells. In some embodiments, a wellhead hanger assembly includes a wellhead hanger, an inner sleeve, a running tool, and an outer sleeve that transmits torque from the running tool to the wellhead hanger to drive rotation of the wellhead hanger. In some instances, the outer sleeve is in castellated engagement with the wellhead hanger, but the outer sleeve could also or instead engage the wellhead hanger in some other manner to transmit torque and drive rotation of the wellhead hanger. The running tool and the outer sleeve may be coupled via dogs that allow the running tool to transmit torque to the outer sleeve when rotated in one direction but not the other. The inner sleeve may include ribs or other projections that interact with slots of the outer sleeve to facilitate disconnection and removal of the inner sleeve from the wellhead hanger.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
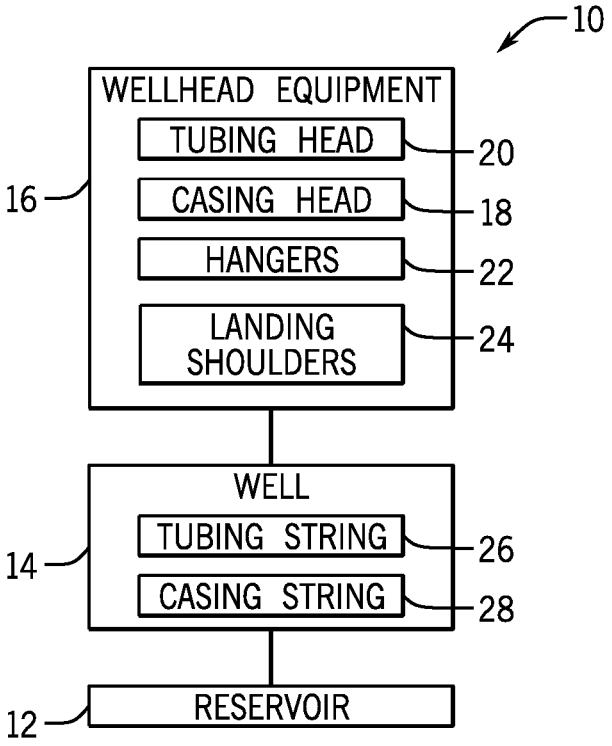
FIG. 1 generally depicts various components, including one or more tubular strings and associated hangers, that can be installed at a well in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one casing head 18 and tubing head 20, as well as wellhead hangers 22. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies or landing rings disposed in the tubing and casing heads. Each of the hangers 22 can be connected to a tubular string, such as a tubing string 26 or a casing string 28, to suspend the string within the well 14. The well 14 can include a single casing string 28 or include multiple casing strings 28 of different diameters. Casing strings 28 are often cemented in place within the well. During a cement job, cement is typically pumped down the casing string. A plug is then pumped down the casing string with a displacement fluid (e.g., drilling mud) to cause the cement to flow out of the bottom of the casing string and up the annular space around the casing string.

Rotating a casing string during cementing can increase uniformity of the cement about the casing string and reduce the size or frequency of undesirable cavities or fissures in the cement. Further, rotating tubular strings can also facilitate running of the strings into the well through the wellhead. Any suitable devices or machines may be used to rotate the wellhead hangers (and their attached tubular strings) and to run the strings into wells. For example, a top drive can be used to run a casing string into a well and to rotate the casing string. In some instances, the tubular strings are rotated via wellhead hangers attached to the strings.

Figure 2:
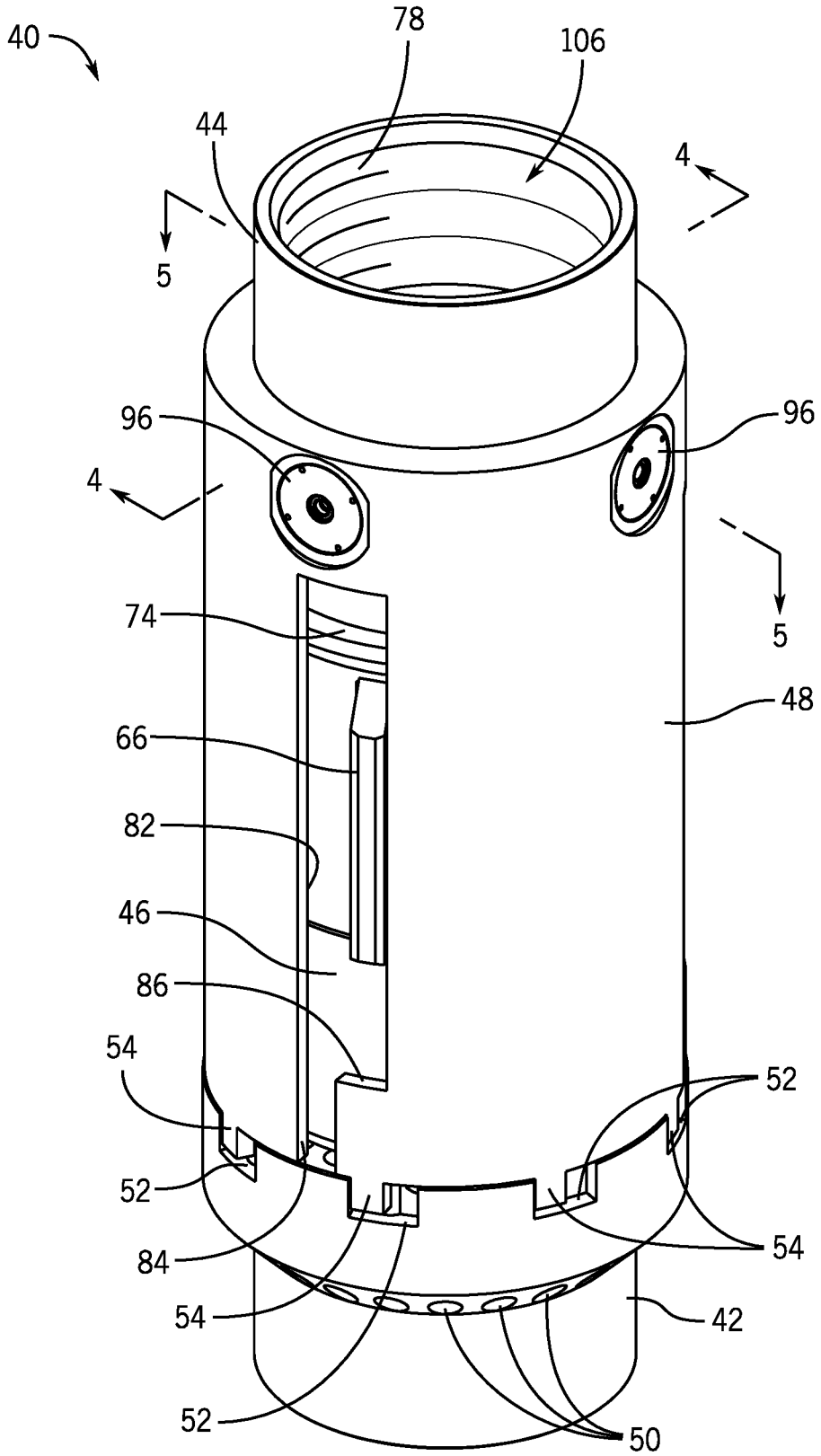
FIG. 2 is a perspective view of a wellhead hanger assembly including a wellhead hanger, a running tool, an inner sleeve, and an outer sleeve for transmitting torque from the running tool to the wellhead hanger in accordance with one embodiment.
Figure 3:
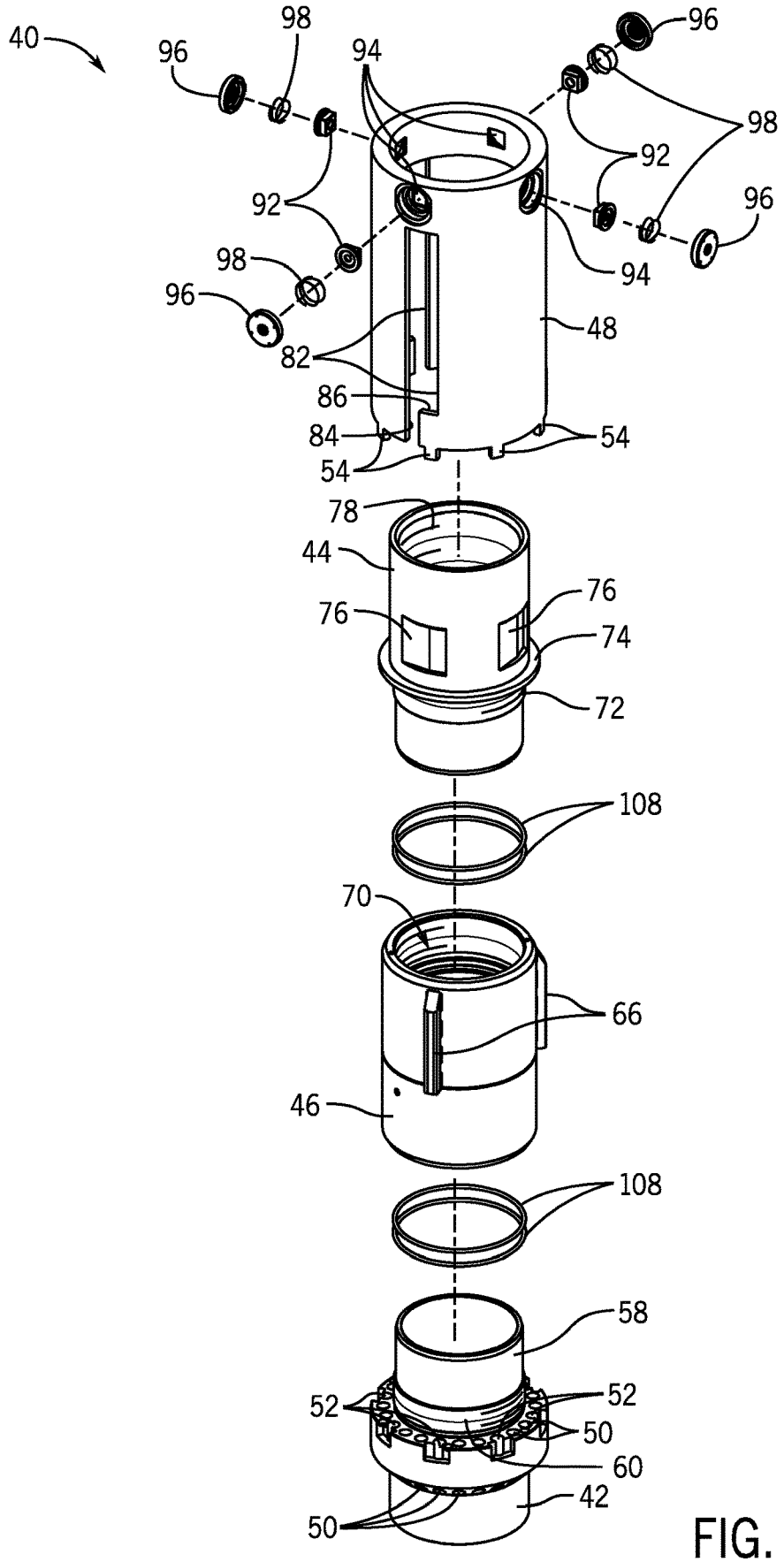
FIG. 3 is an exploded view of the wellhead hanger assembly of FIG. 2 in accordance with one embodiment.
Figure 4:
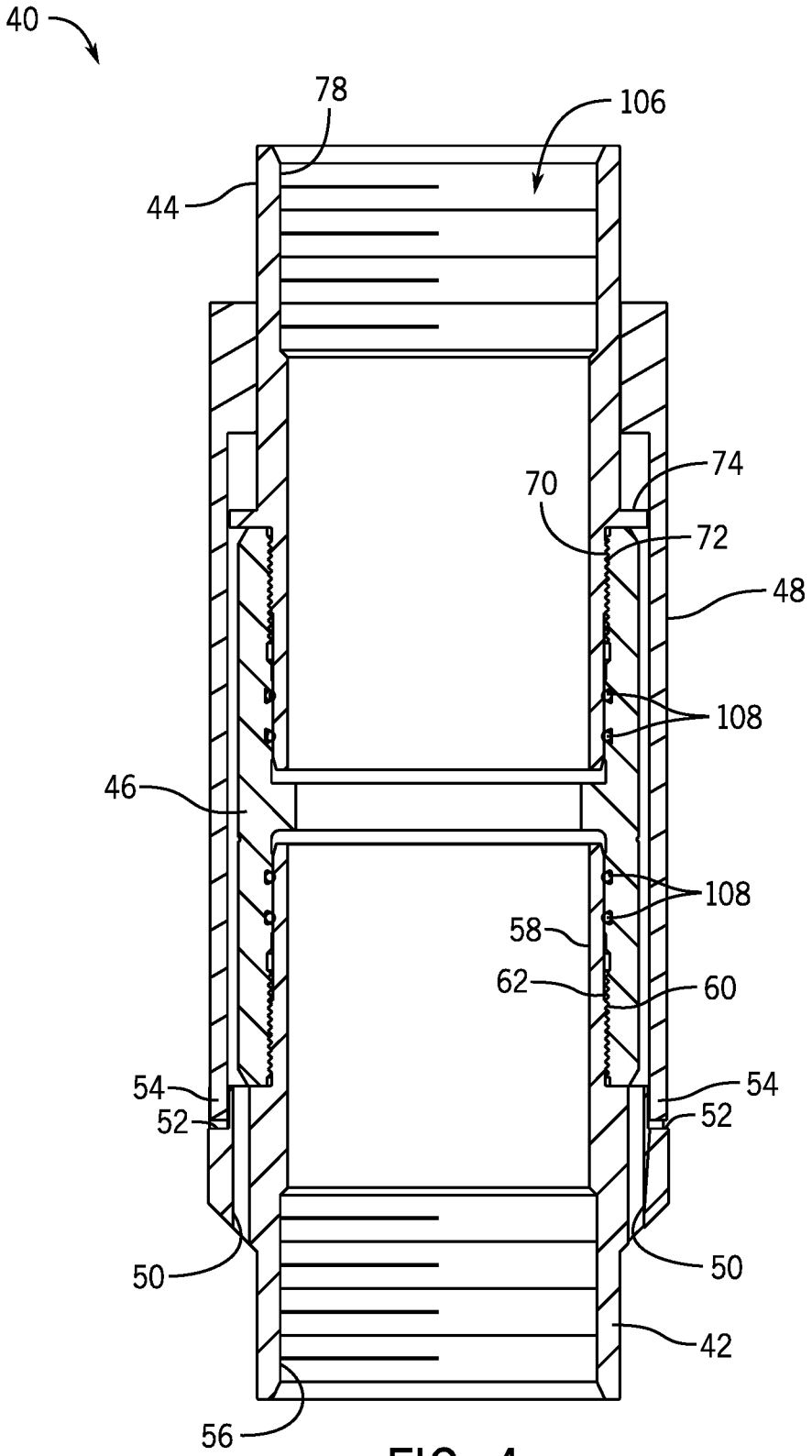
FIG. 4 is an axial cross-section of the wellhead hanger assembly of FIG. 2 in accordance with one embodiment.

One example of a wellhead hanger assembly 40 is generally depicted in FIGS. 2-11. As shown in FIGS. 2-4, the assembly 40 includes a wellhead hanger 42 (provided here as a mandrel-type casing hanger), a running tool 44, an inner sleeve 46, and an outer sleeve 48. The running tool 44 may be coupled to the wellhead hanger 42 by the inner sleeve 46 and the outer sleeve 48 in any suitable manner. As shown in FIGS. 2 and 4, the outer sleeve 48 is positioned to transmit torque from the running tool 44 to the wellhead hanger 42 via castellated engagement of the outer sleeve 48 with the wellhead hanger 42. As described in further detail below, the wellhead hanger assembly 40 may be configured such that the running tool 44 can be rotated (e.g., by a landing joint) in one direction (e.g., clockwise) to drive synchronous rotation of the outer sleeve 48 and the wellhead hanger 42 with the running tool 44, while the running tool 44 can be rotated in an opposite direction (e.g., counterclockwise) to freely rotate the running tool 44 with respect to the outer sleeve 48 and the wellhead hanger 42.

The wellhead hanger 42 is shown in FIGS. 2-4 as having flow-by holes 50 and slots 52 spaced circumferentially about a flange of the wellhead hanger 42. The slots 52 receive castellations 54 of the outer sleeve 48. The castellations 54 may extend axially from the outer sleeve 48 into the mating slots 52 in at least some embodiments, including that shown in FIGS. 2-4. But other arrangements could be used, such as castellations extending radially into slots. Also, the locations of the castellations 54 and the slots 52 could be reversed, with castellations on the wellhead hanger received in slots of the outer sleeve. Mating engagement of the slots 52 and the castellations 54 allow torque to be transmitted from the outer sleeve 48 to the wellhead hanger 42. The wellhead hanger assembly 40 may include any suitable number of castellations 54 and mating slots 52 for transmitting torque between the outer sleeve 48 and the wellhead hanger 42. Additionally, the castellations 54 and slots 52 may have a generally rectangular profile, such as shown in FIGS. 2 and 3, or any other suitable shape.

The wellhead hanger 42 is also depicted as having a threaded surface 56 for receiving a casing string at the bottom of the wellhead hanger 42 and a neck 58 with a threaded surface 60. The depicted inner sleeve 46 includes a threaded surface 62 that allows the inner sleeve 46 to be threaded to the wellhead hanger 42 (via mating engagement of threaded surfaces 60 and 62). The inner sleeve 46 may include radial protrusions that are received by slots in the outer sleeve 48. In FIGS. 2 and 3, these radial protrusions are shown in the form of external ribs 66 that extend axially along the inner sleeve 46 and are received within slots 82 of the outer sleeve 48. As discussed further below, engagement of the external ribs 66 and the slots 82 can facilitate unthreading of the inner sleeve 46 from the wellhead hanger 42.

The inner sleeve 46 may also include a threaded surface 70 for receiving the running tool 44. As shown in FIGS. 3 and 4, the running tool 44 includes a threaded surface 72 the allows the running tool 44 to be threaded to the inner sleeve 46 (via mating engagement of threaded surfaces 70 and 72). The depicted running tool 44 also includes a stop shoulder 74 (e.g., an annular flange) and recesses 76, as well as a threaded surface 78 (e.g., for receiving a landing joint). As discussed below, the shoulder 74 may be used to lift the outer sleeve 48 out of castellated engagement with the wellhead hanger 42. As also discussed further below, the recesses 76 may be one-way torque transmission recesses configured to transmit torque from the running tool 44 to the outer sleeve 48 when the running tool 44 is rotated in one direction (e.g., clockwise) but not when the running tool 44 is rotated in an opposite direction (e.g., counterclockwise).

During assembly of the wellhead hanger assembly 40, the inner sleeve 46 may be threaded to the wellhead hanger 42, the running tool 44 may be threaded to the inner sleeve 46, and the outer sleeve 48 may be positioned in castellated engagement with the wellhead hanger 42. Positioning the outer sleeve 48 in castellated engagement with the wellhead hanger 42 may include moving the outer sleeve axially (e.g., downward along the running tool 44 and the inner sleeve 46) to receive the external ribs 66 of the inner sleeve 46 within the slots 82 of the outer sleeve 48. The slots 82 may include openings 84 in a lower end of the outer sleeve 48, and these openings 84 may be axially aligned with the ribs 66 so that the ribs 66 enter the slots 82 through the openings 84 as the outer sleeve is moved toward the wellhead hanger 42. After receiving the ribs 66 through the openings 84, the ribs 66 may pass into portions of the slots 82 that are wider than the openings 84, and the outer sleeve 48 may be rotated (e.g., clockwise for the assembly 40 depicted in FIGS. 2 and 3) with respect to the inner sleeve 46 such that lateral shoulders 86 of the slots 82 are aligned axially below the ribs 66 (as shown in FIG. 2). After receiving the ribs 66 in the slots 82, the outer sleeve 48 may be moved into castellated engagement with the wellhead hanger 42. In at least one embodiment, such as that depicted in FIGS. 2-4, the wellhead hanger assembly 40 includes three ribs 66, with three mating slots 82, spaced at 120-degree intervals around the assembly 40.

Figure 5:
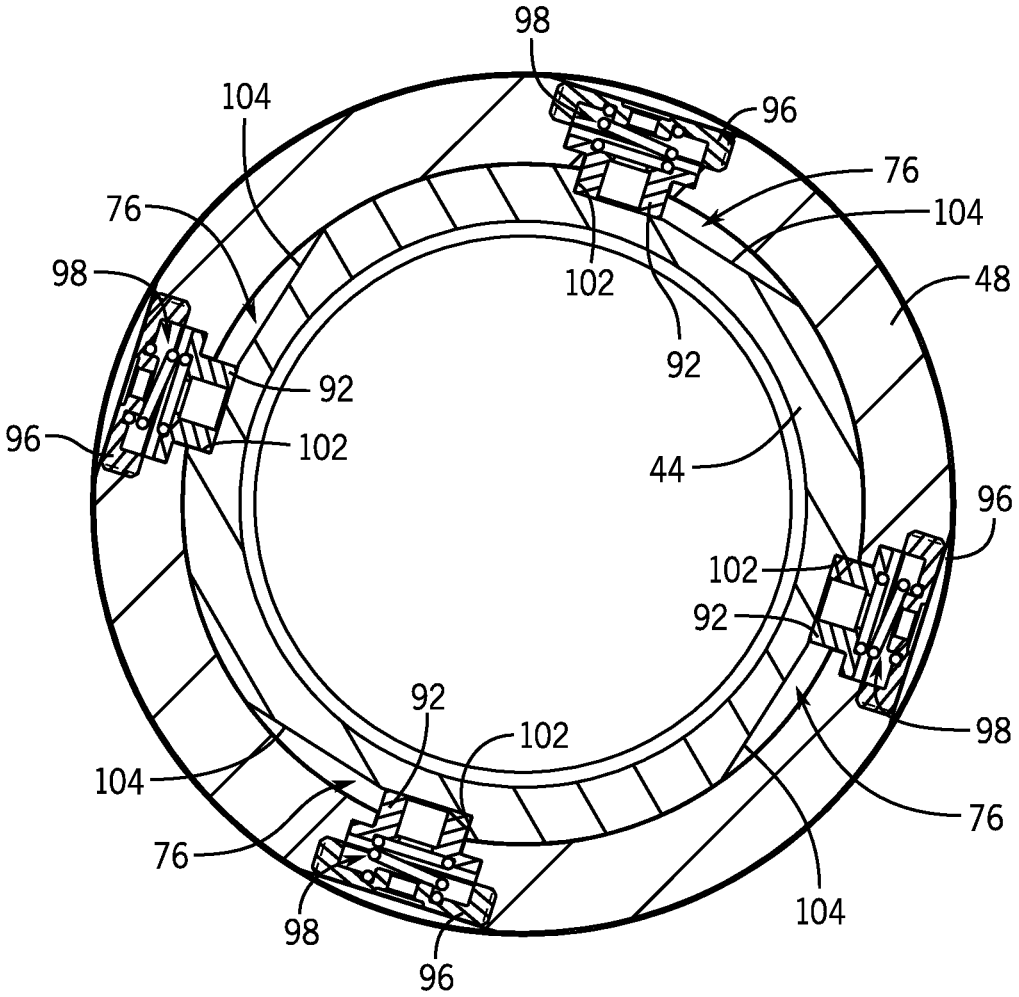
FIG. 5 is a radial cross-section of the wellhead hanger assembly of FIG. 2 in accordance with one embodiment.

The outer sleeve 48 may be coupled to the running tool 44 with dogs 92. As shown in FIGS. 3 and 5, the dogs 92 can be installed in radial openings 94 of the outer sleeve 48 to extend radially inward from the outer sleeve 48 into the recesses 76 of the running tool 44. The dogs 92 may be retained in the openings 94 by caps 96. Springs 98 can be installed between the dogs 92 and the caps 96 to bias the dogs 92 radially inward.

Each recess 76 is shown in FIG. 5 as having a stop surface 102 and an angled return surface 104. In at least some embodiments, the stop surfaces 102 are radial stop surfaces formed orthogonal to the outer circumference of the running tool 44. In the embodiment depicted in FIGS. 2-5, the running tool 44 is rotated clockwise to transmit torque to the outer sleeve 48 via engagement of the stop surfaces 102 with the dogs 92, with the stop surfaces 102 bearing against the dogs 92 to prevent relative rotation of the running tool 44 with respect to the outer sleeve 48. When the running tool 44 is rotated in the opposite direction (counterclockwise for the embodiment depicted in FIGS. 2-5), the running tool 44 rotates with respect to the outer sleeve 48 and the return surfaces 104 push the dogs 92 radially outward, allowing the dogs 92 to exit the recesses 76 and the running tool 44 to freely rotate without driving synchronous rotation of the outer sleeve 48. In other instances, the dogs 92 may also or instead include angled return surfaces 104 that allow the dogs 92 to exit the recesses 76 when the running tool 44 is rotated in the opposite direction (i.e., counterclockwise in the embodiment depicted in FIGS. 2-5).

The wellhead hanger assembly 40 includes a bore 106 that may be used to route fluid (e.g., drilling fluid or cement slurry) into a well. Seals may be provided to inhibit leakage of fluid from the bore 106. For instance, as shown in FIG. 4, seals 108 are positioned to seal between the inner sleeve 46 and the wellhead hanger 42 or the running tool 44.

Figure 6:
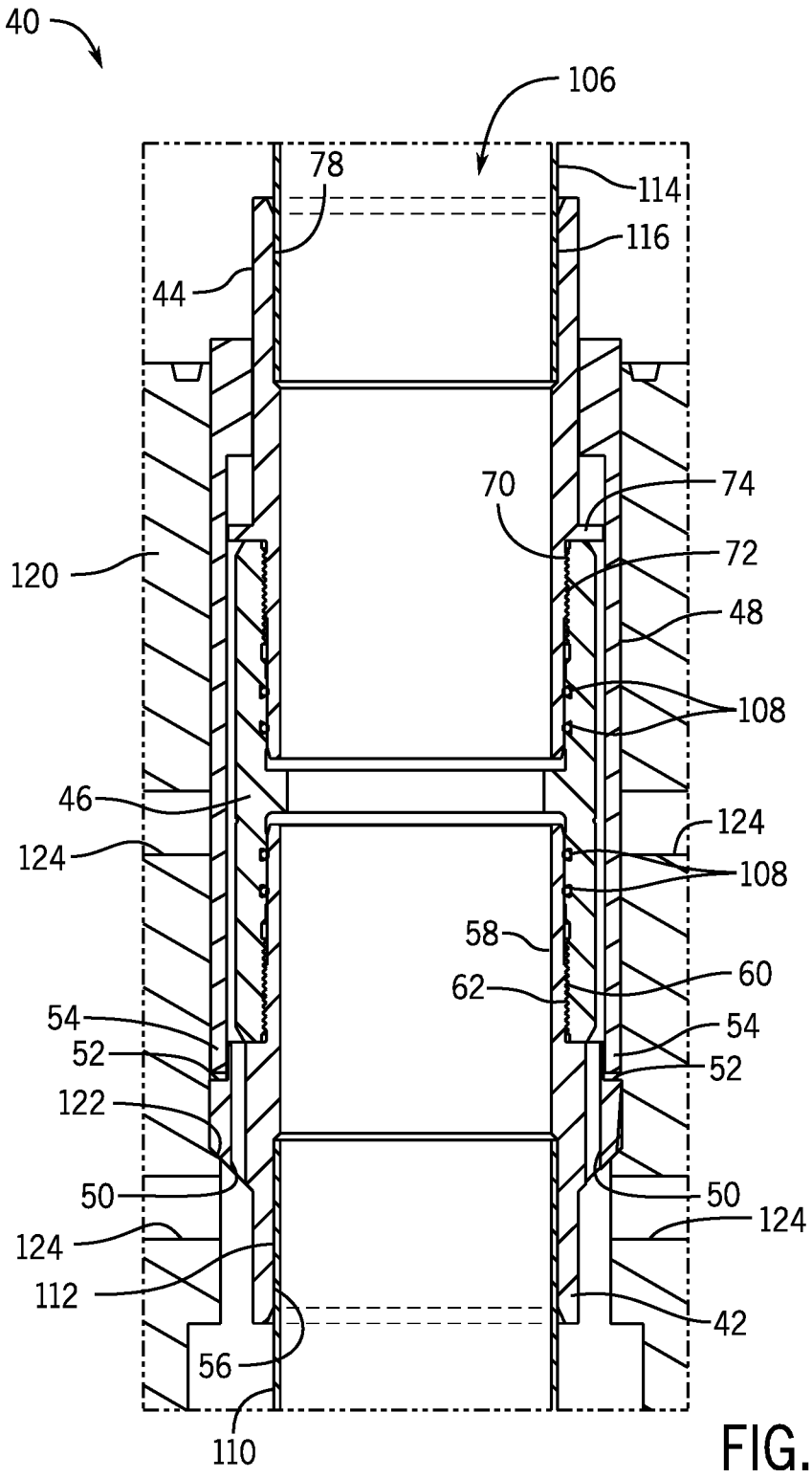
FIGS. 6-11 generally depict a running procedure for installing the wellhead hanger of the wellhead hanger assembly of FIGS. 2-5 in a wellhead in accordance with one embodiment.

FIGS. 6-11 generally depict aspects of a running procedure for installing the wellhead hanger 42 in a wellhead in accordance with one embodiment. As shown in FIG. 6, the wellhead hanger 42 is a casing hanger coupled to a casing string 110 via mating engagement of threaded surface 56 with a threaded surface 112 of the casing string 110. A landing joint 114 with a threaded surface 116 is coupled to the top of the wellhead hanger assembly 40, via mating engagement of threaded surfaces 78 and 116, and may be used to lower the wellhead hanger assembly 40 into a wellhead 120 (e.g., into a casing head or other wellhead housing). As shown in FIG. 6, the wellhead hanger 42 may be landed on a landing shoulder 122 of the wellhead 120, and the wellhead 120 may include access ports 124.

In at least some embodiments, such as that described herein with reference to FIGS. 6-11, the threaded surfaces 56, 70, 72, 78, 112, and 116 have right-handed threads and the threaded surfaces 60 and 62 have left-handed threads. With the wellhead hanger assembly 40 within the wellhead 120, the running tool 44 is rotated clockwise to rotate the wellhead hanger 42 and the attached casing string 110 clockwise. More specifically, clockwise rotation of the running tool 44 drives synchronous rotation of the outer sleeve 48 (via interaction of dogs 92 and stop surfaces 102) and of the wellhead hanger 42 (via castellated engagement with the outer sleeve 48).

Figure 7:
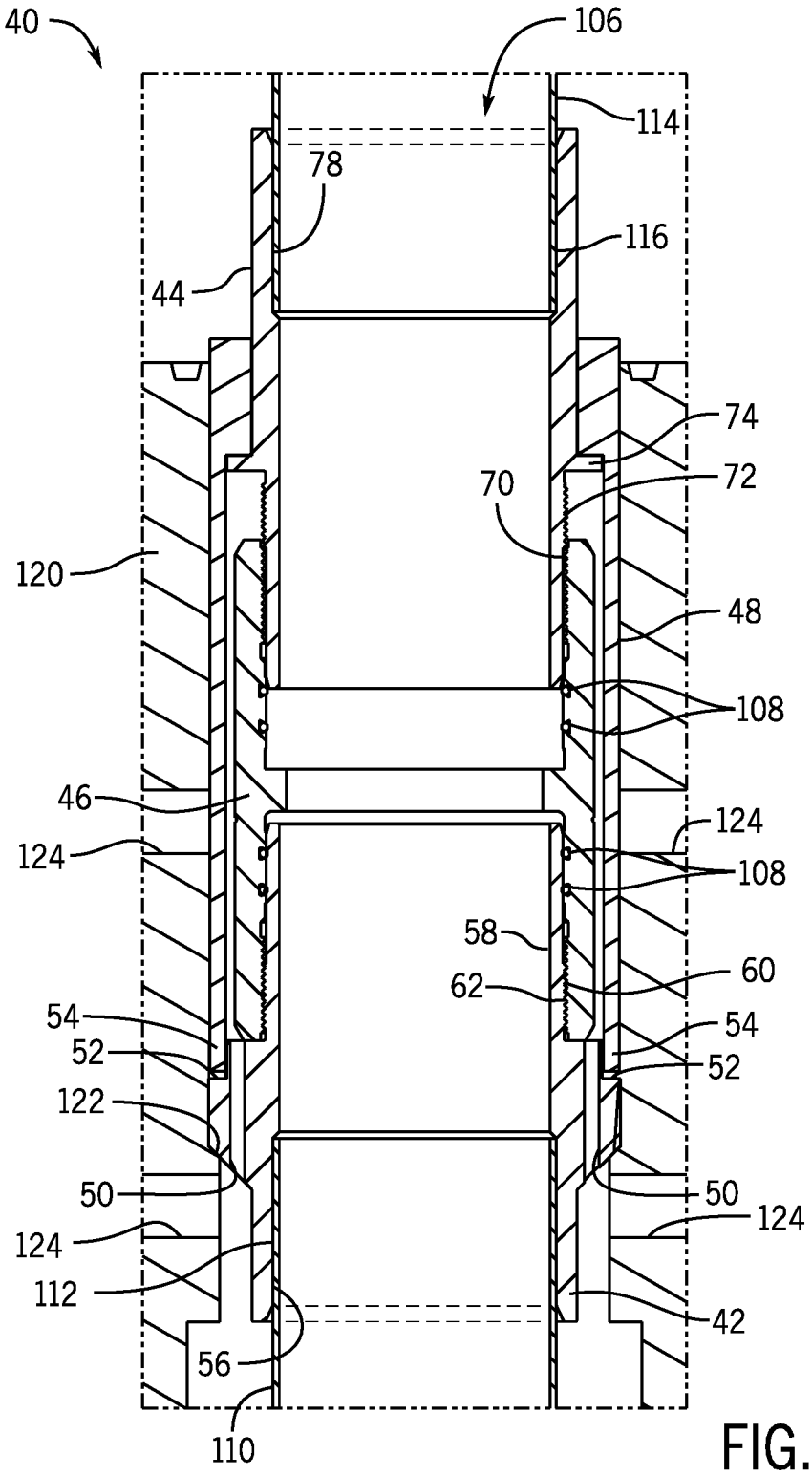

The running tool 44 may then be rotated counterclockwise to unthread the running tool 44 from the inner sleeve 46 and move to the position depicted in FIG. 7. As discussed above, return surfaces 104 of the recesses 76 allow the dogs 92 to exit the recesses 76. This allows the running tool 44 to rotate counterclockwise with respect to the outer sleeve 48 (and the wellhead hanger 42) and unthread from the inner sleeve 46.

Figure 8:
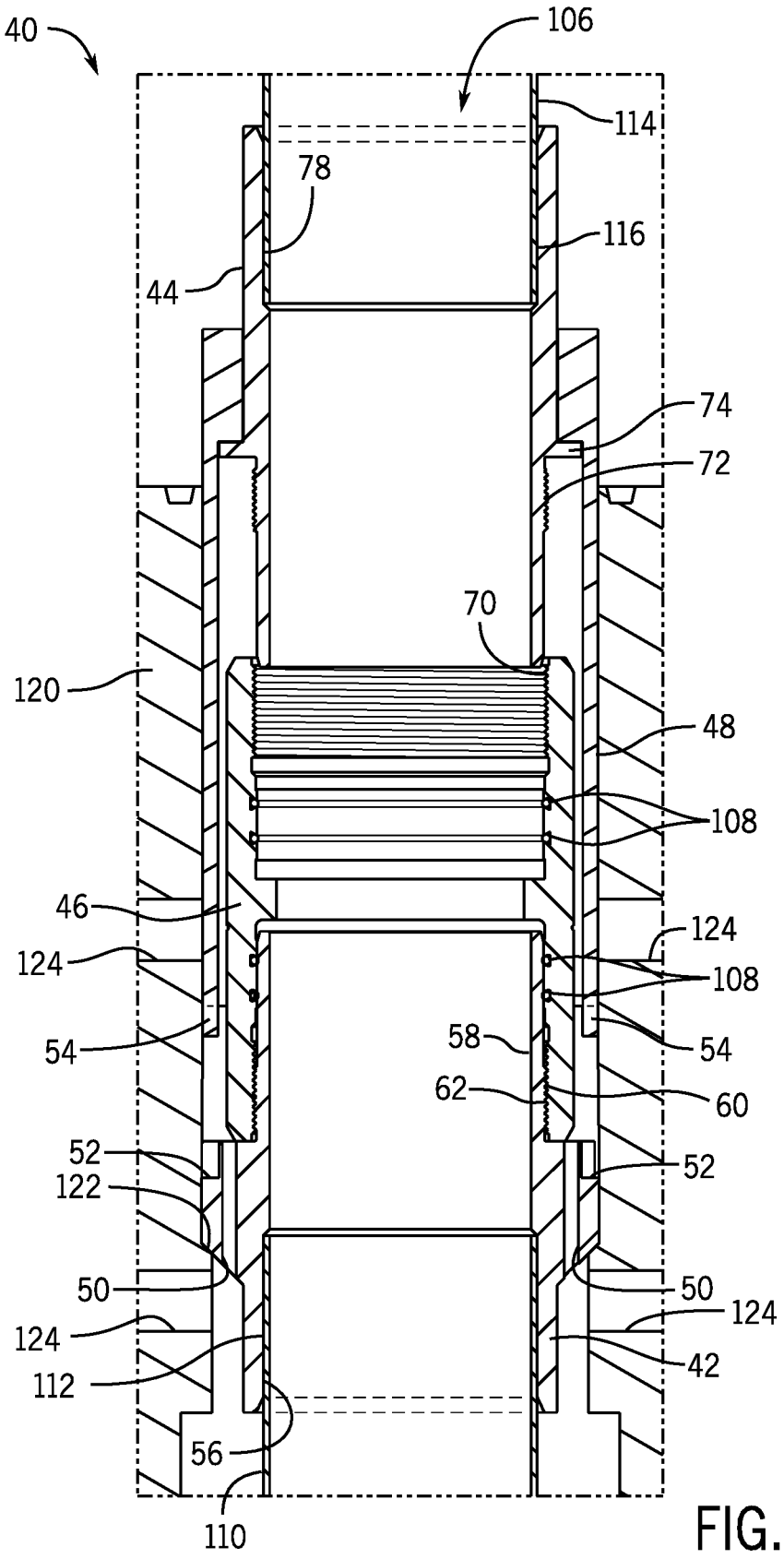
Figure 9:
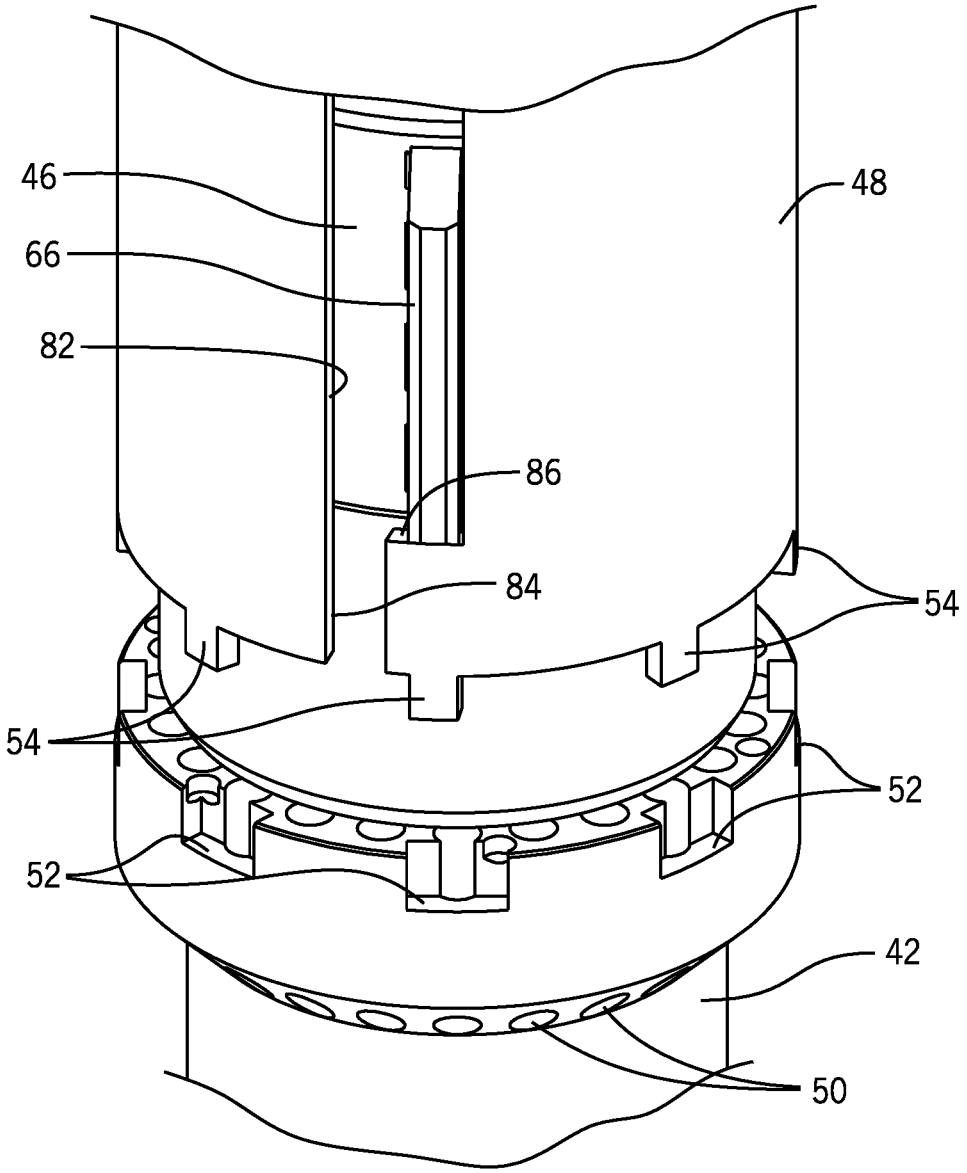
Figure 10:
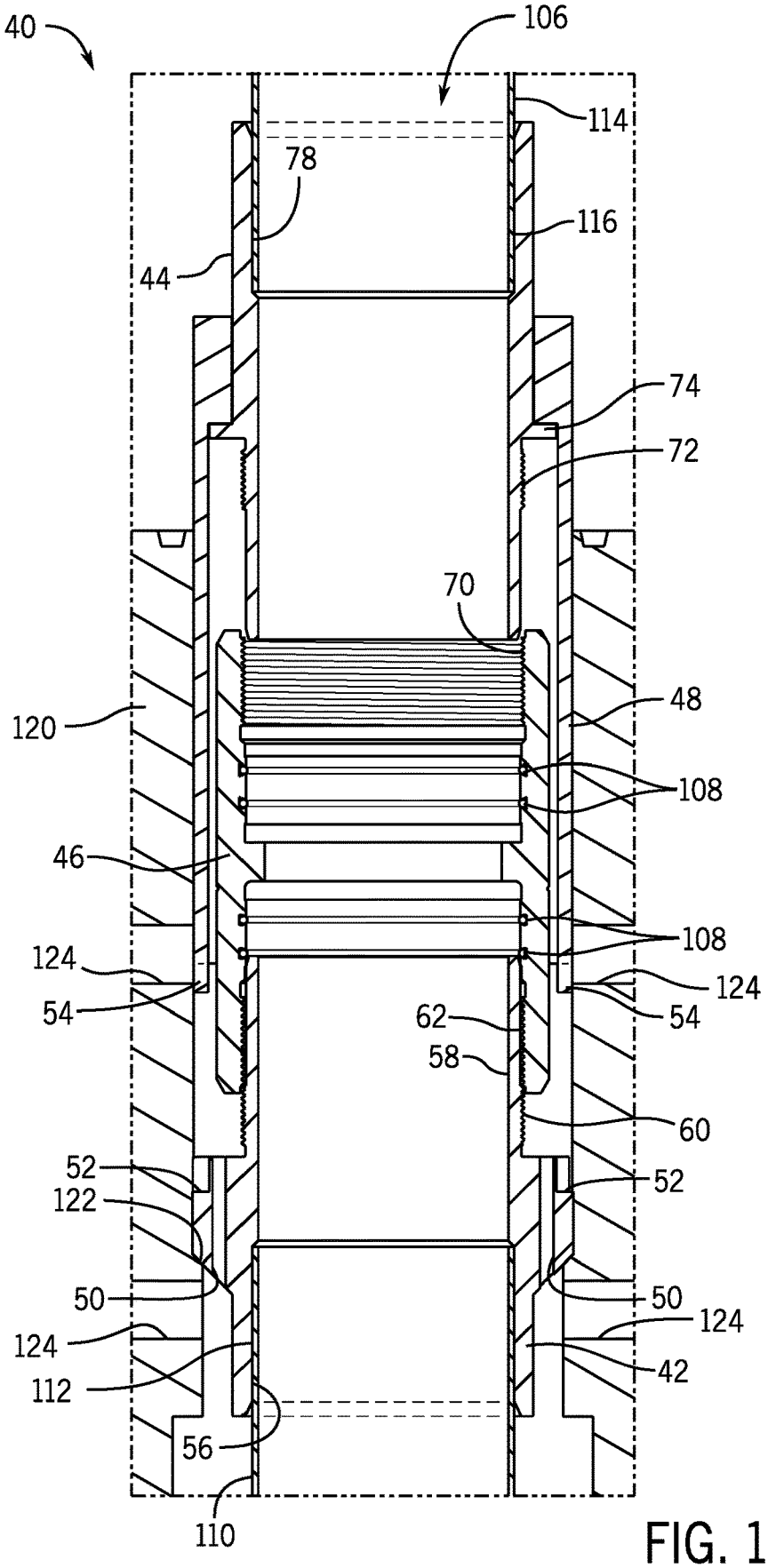

After unthreading the running tool 44 from the inner sleeve 46, the running tool 44 may be pulled away from the wellhead hanger 42 to lift the outer sleeve 48, via the shoulder 74 of the running tool 44, out of castellated engagement with the wellhead hanger 42, as shown in FIGS. 8 and 9. In some instances, the running tool 44 is pulled away from the wellhead hanger 42 until the shoulders 86 of the slots 82 of the outer sleeve 48 contact the lower ends of the ribs 66 of the inner sleeve 46. Once the outer sleeve 48 is pulled out of castellated engagement with the wellhead hanger 42, the running tool 44 may again be rotated clockwise to unthread the inner sleeve 46 from the wellhead hanger 42, as shown in FIG. 10. More specifically, with the outer sleeve 48 freed from the wellhead hanger 42, this clockwise rotation of the running tool 44 drives (via the dogs 92) clockwise rotation of the outer sleeve 48 with respect to the wellhead hanger 42. Sides of the slots 82 of the outer sleeve 48 bear against the ribs 66 of the inner sleeve 46 to drive clockwise rotation of the inner sleeve 46, which unthreads the inner sleeve 46 from the wellhead hanger 42.

Figure 11:
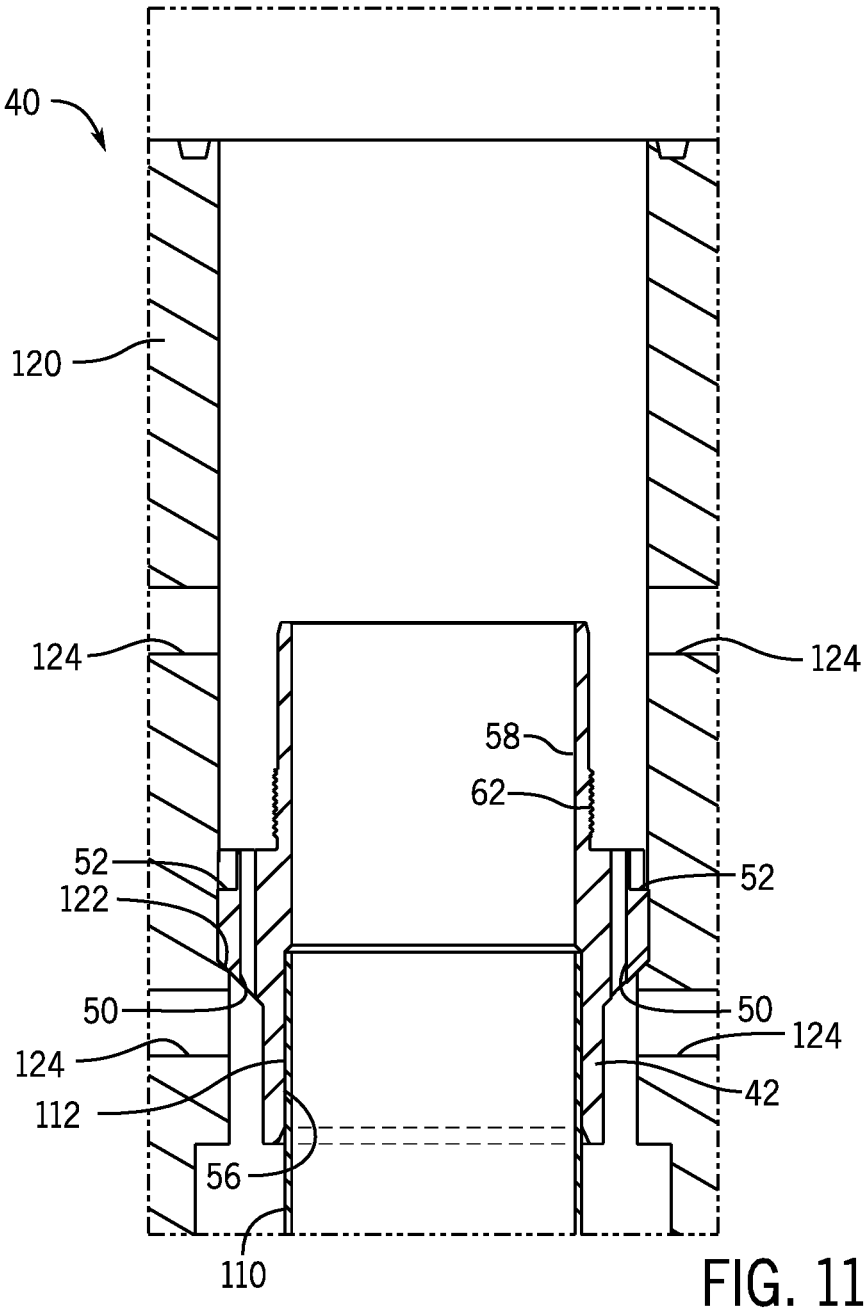

With the inner sleeve 46 unthreaded from the wellhead hanger 42, the running tool 44 may be lifted with a straight pull to remove the running tool 44, the inner sleeve 46, and the outer sleeve 48 from the wellhead 120, leaving the wellhead hanger 42 and the casing string 110 as shown in FIG. 11. The inner sleeve 46 may be carried by the outer sleeve 48 out of the wellhead 120 through engagement of the ribs 66 of the inner sleeve 46 with the shoulders 86 of the slots 82 of the outer sleeve 48.

Figure 12:
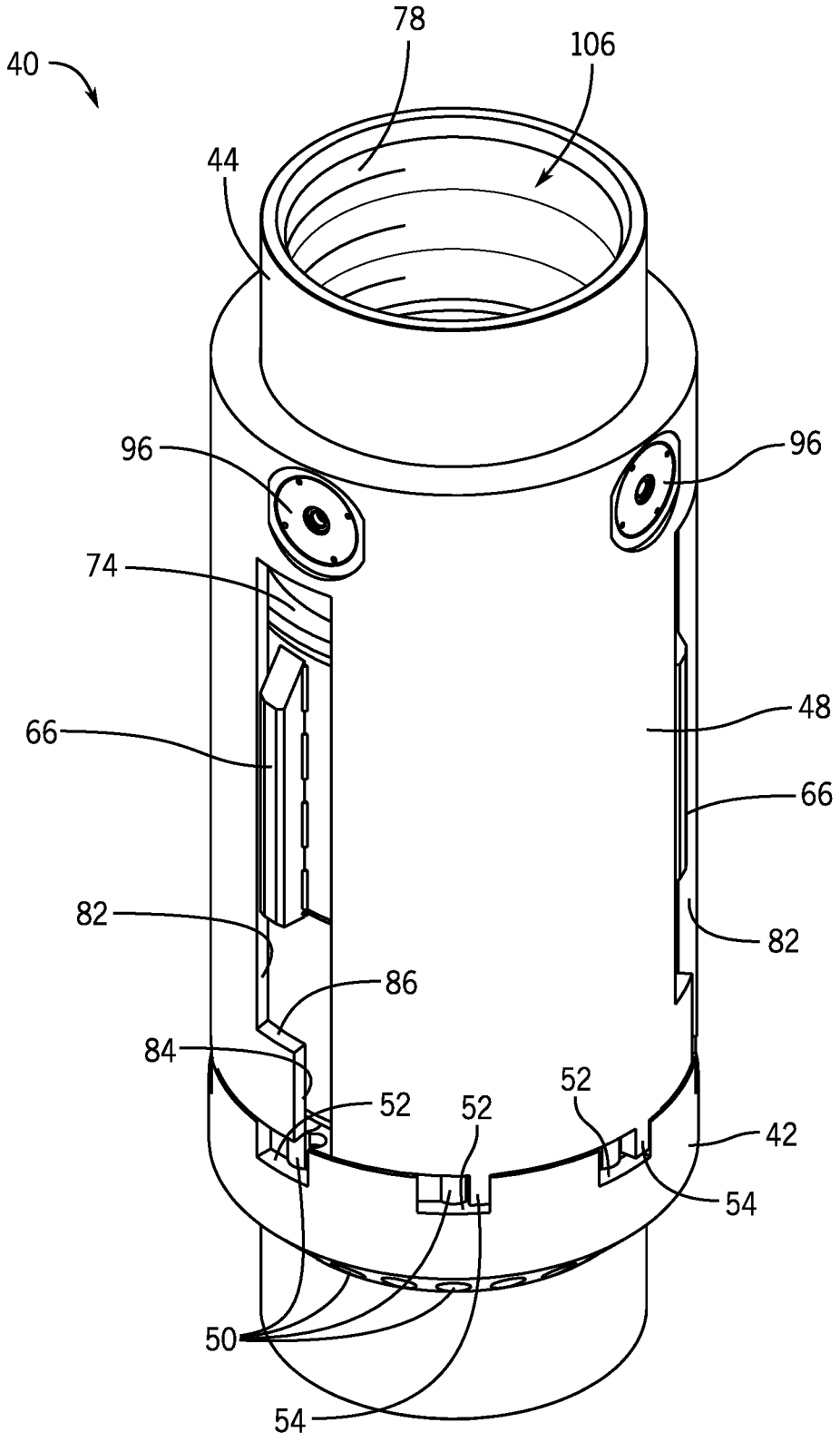
FIG. 12 is a perspective view of another wellhead hanger assembly in accordance with one embodiment.

Although the wellhead hanger assembly 40 may be configured to provide right-handed (clockwise) rotation of the wellhead hanger 42, such as described above with respect to FIGS. 6-11, in other instances a wellhead hanger assembly 40 may be configured for left-handed (counterclockwise) rotation of the wellhead hanger 42. In FIG. 12, for example, a wellhead hanger assembly 40 for left-handed rotation of the wellhead hanger 42 is depicted. This depicted wellhead hanger assembly 40 may be substantially identical to that depicted in FIGS. 2-5 but with the orientation of certain features reversed so that the wellhead hanger 42 can be run into and installed in a wellhead in the manner described above for FIGS. 6-11 (with the directions of rotation also reversed). In the embodiment of FIG. 12, the orientation of the recesses 76 of the running tool 44 is reversed so that counterclockwise rotation of the running tool 44 drives synchronous counterclockwise rotation of the outer sleeve 48, while the running tool 44 can freely rotate in the clockwise direction with respect to the outer sleeve 48. The orientation of the slots 82 of the outer sleeve 48 are also reversed in FIG. 12. Additionally, the thread directions of at least the threaded surfaces 60, 62, 70, and 72 are reversed compared with those described above with respect to FIGS. 6-11 (i.e., the threaded surfaces 60 and 62 have right-handed threads and the threaded surfaces 70 and 72 have left-handed threads in the embodiment of FIG. 12).

Although certain embodiments may be described above in the context of casing hangers, it is noted that the presently disclosed techniques could also be used to rotate other kinds of hangers, such as those connected to other tubular strings or to rods. The running tools and outer sleeves described herein can be used to transmit torque to the hangers (whether casing hangers or some other types of hangers), causing the hangers to rotate synchronously with the running tools. Once rotation is completed and the hangers are landed, the running tools and associated sleeves can be removed from the hangers.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a wellhead hanger;

an inner sleeve coupled to the wellhead hanger;

a running tool coupled to the inner sleeve such that the running tool is coupled to the wellhead hanger via the inner sleeve; and an outer sleeve coupled to the running tool and positioned to transmit torque from the running tool to the wellhead hanger, wherein the wellhead hanger is in castellated engagement with the outer sleeve via a set of castellations and mating slots.

2. The system of claim 1, wherein the set of castellations and mating slots includes castellations on a lower end of the outer sleeve that are received by mating slots in the wellhead hanger.

3. The system of claim 2, wherein the castellations on the lower end of the outer sleeve protrude axially into the mating slots in the wellhead hanger.

4. The system of claim 1, wherein the outer sleeve is coupled to the running tool via dogs.

5. The system of claim 4, wherein the dogs are installed in the outer sleeve and extend radially inward from the outer sleeve to be received within exterior recesses of the running tool.

6. The system of claim 5, wherein the exterior recesses of the running tool include stop surfaces configured to bear against the dogs during rotation of the running tool in a first direction to prevent relative rotation of the running tool with respect to the outer sleeve.

7. The system of claim 6, wherein the dogs or the exterior recesses of the running tool are configured to allow the dogs to exit the exterior recesses by rotating the running tool in a second direction that is opposite the first direction.

8. The system of claim 1, wherein the running tool has a shoulder that is positioned above the inner sleeve and inside the outer sleeve and is configured to lift the outer sleeve out of castellated engagement with the wellhead hanger.

9. The system of claim 1, wherein the inner sleeve includes radial protrusions received within slots of the outer sleeve.

10. The system of claim 9, wherein the radial protrusions include exterior ribs extending axially along the inner sleeve.

11. The system of claim 9, wherein the slots of the outer sleeve include shoulders positioned to lift the inner sleeve from the wellhead hanger following uncoupling of the inner sleeve from the wellhead hanger.

12. The system of claim 1, wherein the inner sleeve includes one end threaded to the wellhead hanger and an opposite end threaded to the running tool.

13. The system of claim 1, wherein the wellhead hanger is a casing hanger coupled to a casing string.

14. The system of claim 1, wherein the wellhead hanger is positioned within a wellhead.

15. A method comprising:

lowering a wellhead hanger assembly into a wellhead, the wellhead hanger assembly including: a wellhead hanger, an inner sleeve coupled to the wellhead hanger, a running tool coupled to the inner sleeve, and an outer sleeve coupled to the running tool and positioned to transmit torque from the running tool to the wellhead hanger;

rotating the wellhead hanger in a first direction within the wellhead by rotating the running tool in the first direction, wherein torque is transmitted from the running tool to the wellhead hanger via the outer sleeve to cause synchronous rotation of the wellhead hanger with the running tool in the first direction;

rotating the running tool in a second direction that is opposite the first direction to unthread the running tool from the inner sleeve;

after unthreading the running tool from the inner sleeve, pulling the running tool away from the wellhead hanger to pull the outer sleeve out of castellated engagement with the wellhead hanger; and after pulling the outer sleeve out of castellated engagement with the wellhead hanger, rotating the running tool in the first direction to cause the outer sleeve to unthread the inner sleeve from the wellhead hanger.

16. The method of claim 15, wherein rotating the running tool in the first direction includes rotating the running tool clockwise and rotating the running tool in the second direction includes rotating the running tool counterclockwise.

17. The method of claim 15, wherein rotating the running tool in the first direction to cause the outer sleeve to unthread the inner sleeve from the wellhead hanger includes rotating the running tool in the first direction such that the outer sleeve bears against, and transmits torque to, an external rib of the inner sleeve.

18. The method of claim 15, comprising removing the running tool, the inner sleeve, and the outer sleeve from the wellhead after the inner sleeve is unthreaded from the wellhead hanger, wherein the inner sleeve is carried by the outer sleeve during removal of the running tool, the inner sleeve, and the outer sleeve from the wellhead.

19. The method of claim 15, comprising assembling the wellhead hanger assembly before lowering the wellhead hanger assembly into the wellhead, wherein assembling the wellhead hanger assembly includes:

threading the inner sleeve to the wellhead hanger;

threading the running tool to the inner sleeve;

positioning the outer sleeve in castellated engagement with the wellhead hanger; and coupling the outer sleeve to the running tool with dogs such that the running tool transmits torque to the outer sleeve via the dogs to drive synchronous rotation of the outer sleeve with the running tool when the running tool is rotated in the first direction and such that the running tool rotates freely with respect to the outer sleeve when the running tool is rotated in the second direction.

20. The method of claim 19, wherein positioning the outer sleeve in castellated engagement with the wellhead hanger comprises:

moving the outer sleeve axially to receive external ribs of the inner sleeve within slots of the outer sleeve;

rotating the outer sleeve with respect to the inner sleeve to position shoulders of the slots of the outer sleeve axially below the external ribs; and further moving the outer sleeve axially into castellated engagement with the wellhead hanger.

* * * * *